US010334666B2

(12) United States Patent
Jeanneteau et al.

(10) Patent No.: US 10,334,666 B2
(45) Date of Patent: Jun. 25, 2019

(54) INDUCTION MODULE AND INDUCTION HOB

(71) Applicant: ELECTROLUX APPLIANCES AKTIEBOLAG, Stockholm (SE)

(72) Inventors: Laurent Jeanneteau, Forli (IT); Alex Viroli, Forli (IT); Massimo Nostro, Forli (IT); Fabio Angeli, Forli (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 0 days.

(21) Appl. No.: 16/067,143

(22) PCT Filed: Feb. 16, 2017

(86) PCT No.: PCT/EP2017/053563
§ 371 (c)(1),
(2) Date: Jun. 29, 2018

(87) PCT Pub. No.: WO2017/140818
PCT Pub. Date: Aug. 24, 2017

(65) Prior Publication Data

US 2019/0014621 A1 Jan. 10, 2019

(30) Foreign Application Priority Data

Feb. 19, 2016 (EP) ..... 16156417

(51) Int. Cl.
*H05B 6/06* (2006.01)
*H05B 6/12* (2006.01)
(Continued)

(52) U.S. Cl.
CPC ..... *H05B 6/065* (2013.01); *H05B 6/04* (2013.01); *H05B 6/062* (2013.01); *H05B 6/1272* (2013.01); *H05B 6/36* (2013.01); *H05B 2213/03* (2013.01)

(58) Field of Classification Search
CPC ..... H05B 6/04; H05B 6/062; H05B 6/065; H05B 6/1209; H05B 6/1272; H05B 6/145;
(Continued)

(56) References Cited

U.S. PATENT DOCUMENTS 6,528,770 B1 3/2003 Akel et al.
2012/0294990 A1 11/2012 Graber et al.
(Continued)

FOREIGN PATENT DOCUMENTS

EP 2712266 A1 3/2014
WO 2007048700 A1 5/2007

OTHER PUBLICATIONS

International Search Report & Written Opinion issued in corresponding PCT application No. PCT/EP2017/053563 dated May 18, 2017, 8 pages.

*Primary Examiner* — Hung D Nguyen
(74) *Attorney, Agent, or Firm* — Pearne & Gordon LLP

(57) ABSTRACT

An induction module powers one or more induction coils. It includes an induction generator; a controller; and a communication interface for coupling with a user interface. The controller is adapted to operate the induction module according to first and a second configuration modes, wherein in the first configuration mode the induction module is configured to directly communicate with the user interface, and in the second configuration mode, the induction module is adapted to be operated either according to a master module or a slave module configuration. In the master module configuration, the induction module is configured to receive user interface information from the user interface and provide operation information to a slave induction module. In the slave module configuration, the induction module is configured to receive operation information from a master induction module and
(Continued)

operate the induction generator according to that operation information.

15 Claims, 2 Drawing Sheets

(51) Int. Cl.
*H05B 6/36* (2006.01)
*H05B 6/04* (2006.01)

(58) Field of Classification Search
CPC ..... H05B 6/36; H05B 6/362; H05B 2213/03; H05B 2213/05; H05B 2213/07
USPC ..... 219/620–627, 660–667, 670, 671, 672, 219/675, 676
See application file for complete search history.

(56) References Cited

U.S. PATENT DOCUMENTS

2014/0251980 A1* 9/2014 Lin ..... H05B 6/065 219/624
2016/0037585 A1* 2/2016 Christiansen ..... H05B 6/065 219/626
2016/0381736 A1* 12/2016 Christiansen ..... H05B 6/065 219/624

* cited by examiner

INDUCTION MODULE AND INDUCTION HOB

The present invention relates to the field of induction cooking devices. More specifically, the present invention is related to an induction module showing improved flexibility of useage in induction hobs with adaptive heating zones as well as induction hobs with fixed heating zones.

BACKGROUND OF THE INVENTION

Induction hobs for preparing food are well known in prior art. Induction hobs typically comprise at least one heating zone which is associated with at least one induction coil. For heating a piece of cookware placed on the heating zone, the induction coil is coupled with electronic driving means for driving an AC current through the induction coil. Said AC current generates a time varying magnetic field. Due to the inductive coupling between the induction coil and the piece of cookware placed above the induction coil, the magnetic field generated by the induction coil causes eddy currents circulating in the piece of cookware. The presence of said eddy currents generates heat within the piece of cookware due to the electrical resistance of said piece of cookware.

Induction hobs may comprise multiple induction coils arranged in an induction coil array. The induction coil array may extend over the whole or essentially the whole cooking surface of the induction hob. For heating a piece of cookware placed on the induction hob array, the induction hob may be adapted to detect, which hob induction coils of said induction hob array are occupied by the piece of cookware in order to power only the occupied hob induction coils. Alternatively, the heating zone may be configured manually by user input at a user interface. Each induction coil or a group of induction coils may be coupled with an induction module which is adapted to provide electrical power to said induction coils.

SUMMARY OF THE INVENTION

It is an objective of the embodiments of the invention to provide an induction module with enhanced flexibility in usage. The objective is solved by the features of the independent claims. Preferred embodiments are given in the dependent claims. If not explicitly indicated otherwise, embodiments of the invention can be freely combined with each other.

According to an aspect, the invention relates to an induction module for powering one or more induction coils of an induction hob. The induction module at least comprises:

- an induction generator for providing electrical power to an induction coil;
- a controller for controlling the induction generator; and
- a communication interface for coupling the induction module with a user interface.

The controller is adapted to operate the induction module at least according to a first and a second configuration mode. In the first configuration mode, the induction module is configured to directly communicate with the user interface. In said second configuration mode, the induction module is adapted to be operated either according to master module or slave module configuration. In master module configuration, the induction module is configured to receive user interface information from the user interface and provide operation information to one or more slave induction modules based on said user interface information. In slave module configuration, the induction module is configured to receive operation information from a master induction module and operate the induction generator according to said operation information.

Said induction module is advantageous because due to the configuration capabilities, specifically using a software configuration of the induction module, the induction module can be used in common induction hobs with fixed heating zones in which the induction modules directly receive information from the user interface as well as in induction hobs with a flexible heating zone configuration. Thereby, the flexibility of usage of said induction module is increased leading to reduced production and storage costs.

According to embodiments, in said slave module configuration, the induction module does not consider information directly provided by the user interface. In other words, the induction modules (master induction module or slave induction module) included in the induction hob are coupled with each other and with the user interface using a single communication bus. So, in said second configuration mode (master-slave-configuration) not only the master induction module but also the slave induction module receives information directly provided by the user interface. However, the slave induction module ignores said information directly provided by the user interface. Thereby it is possible to use a single communication bus for the communication between the induction modules and communication between the master induction module and the user interface.

According to embodiments, the communication interface is configured to couple the induction module with the user interface and one or more further induction modules. In other words, a single communication interface is used for communication with the further induction modules and the user interface. Thereby, the manufacturing costs of the induction modules are further reduced.

According to embodiments, the communication interface is a bus interface for coupling the induction module with a communication bus. Said communication bus may be any bus capable of transmitting information between the induction modules and between the user interface and the master induction module, e.g. serial bus, SP, I2C, RS485 etc.

According to embodiments, the induction module comprises storage means for storing information regarding operating the induction module according to master module configuration or slave module configuration. Said storage may be any storage means for storing information, e.g. a register, a jumper etc. So, only by an appropriate configuration setting, specifically a software setting, the induction module is able to be used according to first configuration mode or second configuration mode. In addition, in case of said second configuration mode, the stored information may indicate if the respective induction module should be operated as master induction module or slave induction module.

According to a further aspect, the invention refers to an induction hob. Induction hob comprises:

- two or more induction coils;
- two or more hardware-identical induction modules, each induction coil being coupled with an induction module, the induction modules being configured to provide electrical power to one or more induction coils; and
- a user interface for receiving user input.

Each induction module comprises a communication interface in order to couple the induction module with a communication bus. Each induction module comprises a controller adapted to operate the induction module according to a master-slave-concept, wherein one of said induction modules is configured as master induction module and the at least one further induction module is configured as slave induction module. The master induction module is adapted to receive user interface information from the user interface and provide operation information to said one or more slave induction modules based on said user interface information. The slave induction module is configured to receive operation information from said master induction module and operate the induction generator according to said operation information.

Said induction hob is advantageous because there is no need for a central controller because the master induction module is configured to take over the task of the central controller. Thereby the structure of the induction hob is significantly reduced.

According to embodiments, the user interface is adapted to provide user interface information to said one or more slave induction modules and said one or more slave induction modules are adapted to reject or ignore said user interface information. In other words, only the master induction module processes the user interface information and provides operation information to the slave induction modules based on said user interface information.

According to embodiments, a single communication bus is used for communication between the master induction module and the user interface and for communication between the master induction module and the one or more slave induction modules. Thereby, the usage of different bus systems for transmission of information between the master induction module and the user interface and transmission of information between the master induction module and the slave induction module can be avoided.

According to embodiments, the master induction module is configured to serve as a central controller for grouping induction coils associated with one or more slave modules in order to form a common cooking area based on said group of induction coils. So, based on a user input defining the configuration of the cooking zone or an automatic pot detection mechanism, the master induction module may determine the induction coils to be activated and provide respective operating information to the slave induction module which are coupled with the induction coils to be activated.

According to embodiments, the master induction module is configured to determine operation information including target power and/or operating frequency of said one or more slave induction modules based on said user interface information.

According to embodiments, the master induction module is configured to determine operation information including target power and/or operating frequency of said one or more slave induction modules based on a noise reduction algorithm. Said noise reduction algorithm may reduce acoustic noise by appropriately choosing the target power and/or operating frequency (AC-current frequency) of each induction coil.

According to embodiments, the master induction module is configured to transmit information regarding the induction coils to be activated, the target power and/or the operating frequency to said one or more slave induction modules. Said information transmission may be performed via the communication bus coupling the master induction module with said one or more slave induction modules.

According to embodiments, the one or more slave induction modules are configured to process the information received from the master induction module and operate the one or more induction coils coupled with said slave module according to said received information. For example, the information provided by the master module may be a broadcast message which is received by all slave modules. The slave modules may activate induction coils according to said information and choose the target power and/or the operating frequency according to the target power or operating frequency information included in said master message.

According to embodiments, the slave induction module is adapted to provide feedback information to said master induction module in order to inform the master induction module about the operation state of the slave induction module. The feedback information may comprise information of the AC current frequency, the reached (electric) power, regulation parameters and/or (heating) zone status flags. Said feedback information (as well as the operation information provided by the master induction module) may be exchanged regularly or periodically between said induction modules and the master induction module may be adapted to choose operational settings to be provided to the slave induction modules in the next step or next loop cycle based on said feedback information.

According to a further aspect, the invention refers to a method for operating an induction hob. The induction hob comprises two or more induction coils and two or more hardware-identical induction modules. Each induction coil is coupled with an induction module in order to provide electrical power to one or more induction coils. Furthermore, the induction hob comprises a user interface for receiving user input. The method comprises the steps of:

- configuring one induction module of said hardware-identical induction modules as master induction module and the further induction modules as slave modules;
- after receiving a user input at the user interface, receiving user interface information at the master induction module;
- processing the user interface information at the master induction module and deriving operation information for said one or more slave induction modules based on said user interface information;
- transmitting operation information from the master induction module to said one or more slave induction modules; and
- operating the induction coil coupled with said one or more slave induction modules based on said operation information.

The terms "essentially", "substantially" or "approximately" as used in the invention means deviations from the exact value by +/−10%, preferably by +/−5% and/or deviations in the form of changes that are insignificant for the function.

BRIEF DESCRIPTION OF THE DRAWINGS

The various aspects of the invention, including its particular features and advantages, will be readily understood from the following detailed description and the accompanying drawings, in which.

DETAILED DESCRIPTION OF PREFERRED EMBODIMENTS

Figure 1:
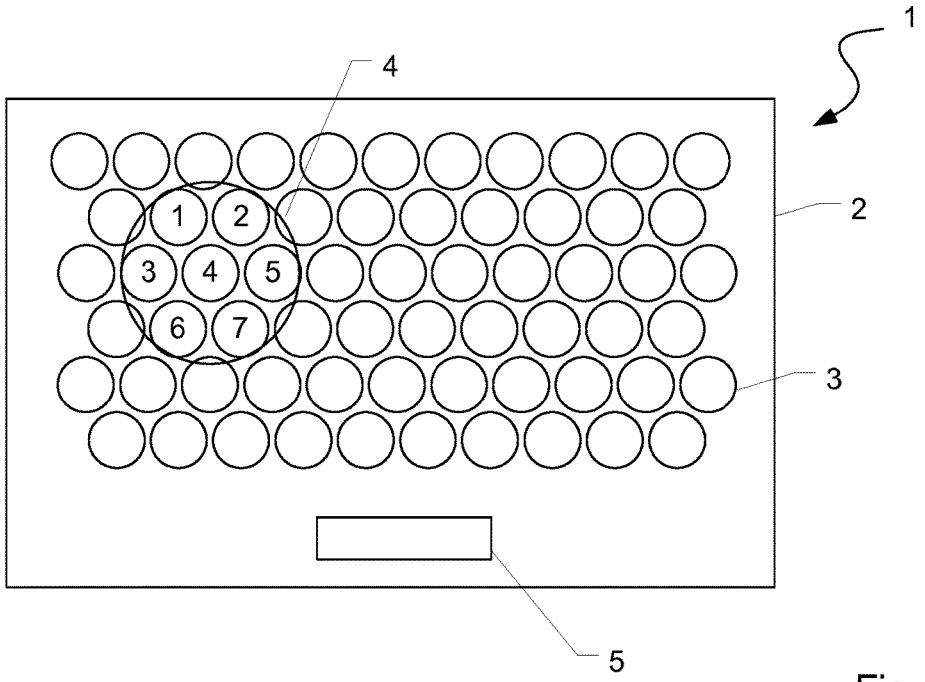
FIG. 1 shows an example schematic top view of an induction hob comprising an induction coil array.

The present invention will now be described more fully with reference to the accompanying drawings, in which example embodiments are shown. However, this invention should not be construed m as limited to the embodiments set forth herein. Throughout the following description similar reference numerals have been used to denote similar elements, parts, items or features, when applicable.

FIG. 1 shows an induction hob 1 according to an embodiment. The induction hob 1 comprises a cooking surface 2, e.g. a glass ceramic plate and a plurality of induction coils 3 which are placed beneath the cooking surface 2. The induction coils 3 may be arranged in a matrix-like manner in order to build an induction coil array. The induction coils 3 form heating elements being adapted to heat a piece of cookware 4 placed on the cooking surface 2 by induction heating. By means of said multiple induction coils 3, an induction hob 1 with adjustable heating areas is achieved because by activating a certain subset of said induction coils 3, the size and/or shape of the cooking area can be varied. Said variation of cooking area may be obtained based on user input at a user interface 5 (e.g. touch sensible area, buttons etc.) or based on an automatic pot detection process.

According to said automatic pot detection process, the induction coils 3 are not only used to cook or heat the food contained in the piece of cookware 4, but also to identify the position of the overlying piece of cookware 4. When a piece of cookware 4 is disposed in any position on the induction hob 1, its position is identified, with consequent determination of which induction coils 3 lie below said piece of cookware (according to FIG. 1, induction coils 1 to 7 are placed below the cookware). Only the induction coils 3 being occupied by the piece of cookware 4 will be activated during heating the piece of cookware 4.

Figure 2:
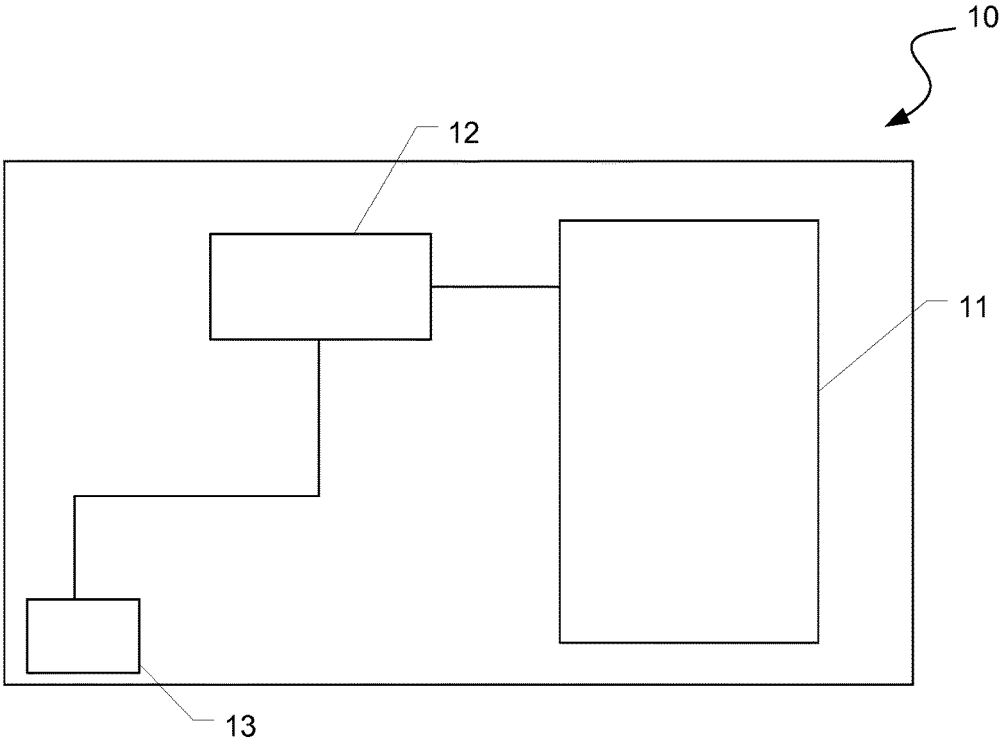
FIG. 2 shows an example schematic block diagram of an induction module.

In order to provide electrical power to said induction coils 3, the induction hob 1 comprises multiple induction modules 10. Each induction module 10 may be coupled with one or more induction coils 1 in order to provide electrical power to said induction coils 1. FIG. 2 shows a schematic block diagram of an induction module 10. The induction module 10 comprises one or more induction generators 11. Each induction generator 11 may be adapted to power an induction coil 3. According to embodiments, the induction module 10 may comprise multiple induction generators 11 (e.g. two or four induction generators 11) for powering multiple induction coils 3. In addition, the induction module 10 may comprise a controller 12 (e.g. a microcontroller or microprocessor). Said controller 12 may be adapted to control said one or more induction generators 11 (e.g. the electrical power provided to the induction coils 3 and/or the frequency of the AC current provided to said induction coils 3).

Furthermore, the induction module 10 comprises a communication interface 13 for coupling the induction module 10 with the user interface 5 and one or more further induction modules 10. For example, the communication interface 13 may be adapted to be coupled with a communication bus 14 (e.g. serial line, SP, I2C, RS485 etc.) in order to exchange information between the user interface 5 and the induction modules 10. Based on said communication interface 13, the induction modules 10 may also be able to exchange information between each other.

For example, an induction module 10 may further comprise a bridge rectifier to supply the induction generator 11 with electrical power, a heat sink for removing heat from the electrical power elements (IGBTs or other powers switching elements, bridge rectifier, etc.). In addition, each induction module 10 may comprise a housing or enclosure in which upper-mentioned elements are arranged. Said housing may be adapted such that multiple induction modules 10 can be assembled side-by-side in order to form an induction module array (required for powering a plurality of induction coils of an induction coil array). Preferably, each induction module 10 may comprise a fan for cooling down the elements included in the induction module 10. Alternatively, an external fan may be used to cool down elements included in multiple induction modules 10.

According to embodiments, an induction module 10 may comprise all components required for powering one or more induction coils 3. So, when coupling the induction module 10 with one or more induction coils 3 and a user interface 5, a fully functional induction hob 1 is obtained.

Figure 3:
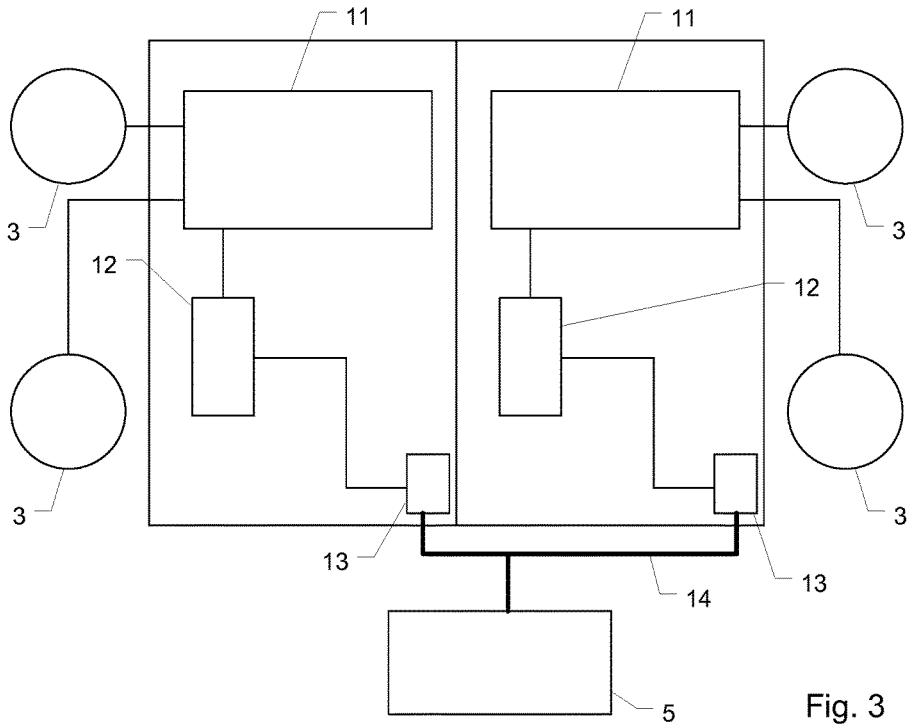
FIG. 3 shows an example arrangement of two induction modules coupled with induction coils and a user interface.

FIG. 3 shows an induction hob 1 comprising two induction modules 10. Each induction module may be coupled with a pair of induction coils 3 in order to provide electric power to said induction coils 3. Furthermore, the induction modules 10 are coupled with a user interface 5. More in detail, the communication interface 13 of the respective induction modules 10 is coupled with the user interface 5 via a communication bus 14. It is worth mentioning that the number of induction modules 10 and induction coils 3 is a mere example, i.e. according to other embodiments the induction hob 1 may comprise more induction modules 10 an/or the induction modules 10 may be configured to drive more or less induction coils 3 (e.g. 1 or 4).

The induction modules 10 included in the induction hob 1 are identical in view of their hardware. However, in order to improve the flexibility of usage of the induction modules 10, the induction modules 10 are software-configurable in order to be operated according to at least the first and a second configuration mode. The induction modules 10 may comprise a storage, register or similar means (e.g. a jumper) for defining the configuration mode according to which the respective induction module 10 is operated.

According to the first configuration mode, each induction module 10 included in the induction hob 1 is configured to communicate with the user interface 5 and directly receive information from said user interface 5 regarding the powering of the one or more induction coils 3 coupled with the induction module 10. In other words, all induction modules 10 are on the same hierarchical level and have the same functionality (no master-slave configuration). In said configuration, the user interface 5 directly transmits operating commands to each of said induction modules 10 by means of said communication bus 14. By using one or more induction modules 10 being configured according to said first configuration mode, an induction hob 1 can be obtained in which each induction coil 3 is associated with a certain fixed heating zone.

In order to use the same (i.e. hardware-identical) induction module 10 in a more sophisticated induction hob 1, e.g. an induction hob 1 with free configurable heating zones, the induction module 10 is adapted to be configured according to a second configuration mode. In said second configuration mode, a respective induction module 10 can be operated as a master induction module or a slave induction module in order to obtain a master-slave configuration of multiple induction modules 10 included in the induction hob 1.

In said master-slave configuration, one induction module 10 of the induction modules 10 included in an induction hob 1 is configured as master induction module and the further induction modules are configured as slave induction modules. Similar to the embodiment described before, the master induction module, the slave induction modules and the user interface 5 are connected with each other by means of a single communication bus 14. However, the slave induction modules do not directly exchange information with the user interface 5 but the information exchange is provided via the master induction module. Said master induction module directly communicates with the user interface 5 thereby receiving information regarding the heating zones requested by the user and the heating power to be provided to said heating zones. The master induction module is adapted to process the information received by the user interface 5 and provide operating information to each of said slave induction modules. Said operating information may comprise information regarding which induction coil 3 has to be activated, the electric power to be provided to the respective induction coil 3 and/or the AC current frequency to be applied to the respective induction coil 3. It is worth mentioning that—due to the usage of the communication bus 14—the master induction module as well as the slave induction modules receive the information provided by the user interface 5 via said communication bus 14. However, the slave induction modules do not process information received directly from the user interface 5, i.e. reject said information and do only process information received by said master induction module. In other words, from the viewpoint of the slave induction modules, the master induction module represents a central controlling module, i.e. an additional central controller (independent controller separate from the master induction module) for handling said master-slave configuration can be avoided.

The master induction module may be adapted to provide operation information to said slave induction modules based on a noise reduction algorithm. Said noise reduction algorithm may be configured to reduce acoustic noise by an appropriate selection of operating frequency and/or operating power of the respective induction coils 3. So, in other words, the master induction module is adapted to assign operating frequencies and/or operating power to the respective induction coils 3 coupled with the slave induction modules by calculating appropriate operating frequencies and/or operating power for the respective induction coils 3 and providing information regarding said appropriate operating frequencies and/or operating power to the respective slave induction modules using the communication bus 14.

In order to be able to control the slave induction modules by means of the master induction module, a periodic or regular information exchange between the master induction module and the slave induction modules may be performed. In other words, the master and slave induction modules exchange information using a message loop.

Figure 4:
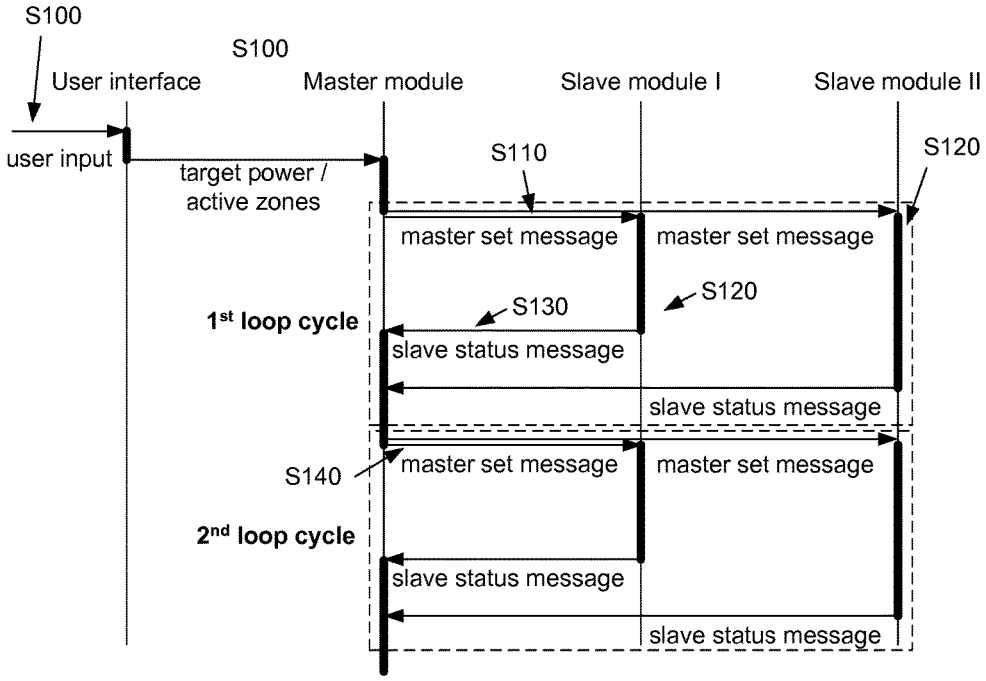
FIG. 4 shows a flow diagram illustrating the information flow in a master-slave configuration of multiple induction modules.

FIG. 4 shows a flow diagram illustrating the information flow between the user interface 5, the master induction module and the slave induction modules. In a first step (S100), a power request is received at the user interface 5. Said power request may be initiated by a user input at the user interface 5. Said user input may trigger a message transmitted from the user interface 5 to the master induction module via the communication bus 14. The message may comprise information regarding the target power to be provided at a respective heating zone (also referred to as user interface information). As mentioned before, said message is received at the master induction module as a well as the one or more slave induction modules. However, said message is only processed at the master induction module. The slave induction modules may ignore the message directly provided by the user interface 5.

After the receiving the user interface information, the master induction module provides operation information to said one or more slave induction modules (master set message, S110). The operation information may be a broadcast message sent to all slave induction modules at the same time. According to other embodiments, different operation information may be provided to the respective slave induction modules.

The operation information may include information regarding which induction coil 3 has to be activated, the operating power of the respective induction coil 3 and/or the AC current frequency to be provided to the respective induction coil. As already mentioned before, said operation parameters may be determined by the master induction module according to an acoustic noise reduction mechanism.

The slave induction modules may process the received operation information (S120). In case that a broad cost message is used for providing operation information to the slave induction modules, a respective slave induction module may extract information which is addressed to it and may operate the one or more induction generators 11 according to said information. More in detail, each slave induction module may be adapted to activate an induction coil 3 based on said received information and choose the operating power and/or the AC current frequency according to said received information. In addition, the slave induction modules may be adapted to transmit a status message back to the master induction module (also referred to as feedback message) (S130). Said status message may comprise information regarding the AC current frequency provided to the respective induction coils, the reached (electric) power, regulation parameters and/or zone status flags.

The master induction module receives said feedback message and may define—according to the acoustic noise reduction algorithm—the active coils, the target (electrical) power and/or the AC current frequency for the next message loop cycle. Said updated information may be provided to the slave induction modules using a further operation information message transmitted by the master induction module to the slave induction modules via said communication bus 14 (S140). Thus, the message exchange between the master induction module and the slave induction module(s) may be repeated.

In order to avoid a transmission bottleneck at the communication bus 14, the timing of the message is choosing by taking care of the communication bus load.

In case that the master induction module does not receive feedback messages of all slave induction modules, or the slave induction module's do not receive the operating information message provided by the master induction module after a defined timeout, the induction modules 10 are switched off.

Above, embodiments of an induction module according to the present invention as defined in the appended claims have been described. These should be seen as merely non-limiting examples. As understood by a skilled person, many modifications and alternative embodiments are possible within the scope of the invention.

LIST OF REFERENCE NUMERALS

1 induction hob
2 cooking surface
3 induction coil
4 piece of cookware
5 user interface

10 induction module
11 induction generator
12 controller
13 communication interface
14 communication bus

The invention claimed is:

1. An induction module for powering one or more induction coils of an induction hob, the induction module at least comprising:

an induction generator for providing electrical power to an induction coil;

a controller for controlling the induction generator;

a communication interface for coupling the induction module with a user interface;

wherein the controller is adapted to operate the induction module at least according to a first and a second configuration mode, wherein in the first configuration mode, the induction module is configured to directly communicate with the user interface, and wherein in said second configuration mode, the induction module is adapted to be operated either according to a master module configuration or a slave module configuration, wherein in the master module configuration, the induction module is configured to receive user interface information from the user interface and provide operation information to one or more slave induction modules based on said user interface information, and wherein in the slave module configuration, the induction module is configured to receive operation information from a master induction module and operate the induction generator according to said operation information.

2. The induction module according to claim 1, wherein in said slave module configuration, the induction module does not consider information directly provided by the user interface.

3. The induction module according to claim 1, wherein the communication interface is configured to couple the induction module with the user interface and one or more further induction modules.

4. The induction module according to claim 1, wherein the communication interface is a bus interface for coupling the induction module with a communication bus.

5. The induction module according to claim 1, comprising storage means for storing information regarding operating the induction module according to said master module configuration or said slave module configuration.

6. An induction hob comprising:

two or more induction coils;

two or more hardware-identical induction modules, each said induction coil being coupled with a said induction module, the induction modules being configured to provide electrical power to one or more of the induction coils; and a user interface for receiving user input;

wherein each induction module comprises a communication interface in order to couple the induction module with a communication bus, wherein each induction module comprises a controller adapted to operate the induction module according to a master-slave-concept, wherein one of said induction modules is configured as a master induction module and one or more of said induction modules is configured as a slave induction module, wherein the master induction module is adapted to receive user interface information from the user interface and provide operation information to said one or more slave induction modules based on said user interface information and wherein the one or more slave induction modules is configured to receive operation information from said master induction module and operate the induction generator according to said operation information.

7. The induction hob according to claim 6, wherein the user interface is adapted to provide user interface information to said one or more slave induction modules and said one or more slave induction modules are adapted to reject or ignore said user interface information.

8. The induction hob according to claim 6, wherein a single communication bus is used for communication between the master induction module and the user interface and for communication between the master induction module and the one or more slave induction modules.

9. The induction hob according to claim 6, wherein the master induction module is configured to serve as a central controller for grouping induction coils associated with one or more of said slave modules in order to form a common cooking area based on said group of induction coils.

10. The induction hob according to claim 6, wherein the master induction module is configured to determine operation information including target power and/or operating frequency of said one or more slave induction modules based on said user interface information.

11. The induction hob according to claim 6, wherein the master induction module is configured to determine operation information including target power and/or operating frequency of said one or more slave induction modules based on a noise reduction algorithm.

12. The induction hob according to claim 6, wherein the master induction module is configured to transmit information regarding the induction coils to be activated, the target power and/or the operating frequency to said one or more slave induction modules.

13. The induction hob according to claim 12, wherein the one or more slave induction modules are configured to process the information received from the master induction module and operate the one or more induction coils coupled with said one or more slave modules according to said received information.

14. The induction hob according to claim 6, wherein the one or more slave induction modules is adapted to provide feedback information to said master induction module in order to inform the master induction module about the operation state of the one or more slave induction modules.

15. A method for operating an induction hob, the induction hob comprising two or more induction coils, two or more hardware-identical induction modules, each induction coil being coupled with an induction module in order to provide electrical power to one or more of said induction coils and a user interface for receiving user input, the method comprising the steps of:

configuring one induction module of said hardware-identical induction modules as a master induction module and at least one further said induction module as a slave module;

after receiving a user input at the user interface, receiving user interface information at the master induction module;

processing the user interface information at the master induction module and deriving operation information for said one or more slave induction modules based on said user interface information;

transmitting said operation information from the master induction module to said one or more slave induction modules; and operating the induction coil coupled with said one or more slave induction modules based on said operation information.

* * * * *